US010945477B2

(12) United States Patent
Geisinsky et al.

(10) Patent No.: US 10,945,477 B2
(45) Date of Patent: Mar. 16, 2021

(54) WIG GRIP APPARATUS

(71) Applicant: NG Imports, Inc., Long Beach, CA (US)

(72) Inventors: Yehudis Geisinsky, Long Beach, CA (US); Yitzchok Geisinsky, Long Beach, CA (US)

(73) Assignee: NG Imports, Inc., Long Beach, CA (US)

( * ) Notice: Subject to any disclaimer, the term of this patent is extended or adjusted under 35 U.S.C. 154(b) by 0 days.

(21) Appl. No.: 16/276,579

(22) Filed: Feb. 14, 2019

(65) Prior Publication Data

US 2020/0015532 A1 Jan. 16, 2020

(51) Int. Cl.
*A41G 5/00* (2006.01)
*A41G 3/00* (2006.01)

(52) U.S. Cl.
CPC ..... *A41G 3/0016* (2013.01)

(58) Field of Classification Search
CPC ..... A41G 3/00; A41G 3/0008; A41G 3/0016; A41G 3/0033; A41G 3/0041; A41G 3/005;

(Continued)

(56) References Cited

U.S. PATENT DOCUMENTS 1,207,574 A * 12/1916 Lewis ..... A45D 8/40 132/274
1,545,881 A * 7/1925 Cohen ..... A41G 3/0041 132/54

(Continued)

FOREIGN PATENT DOCUMENTS

DE 337251 C * 5/1921 ..... A41G 3/00
DE 202014104804 U1 * 10/2014 ..... A41G 3/0008

(Continued)

OTHER PUBLICATIONS

GB Design Registration No. 4035095, entitled "Head band with wireless communication device built in"; Publication date Apr. 24, 2014; Registration owner: Bluefingers Laboratories Europe Limited.

(Continued)

*Primary Examiner* — Rachel R Steitz
(74) *Attorney, Agent, or Firm* — Lance M. Pritikin

(57) ABSTRACT

An exemplary wig grip apparatus includes a first securement member, a second securement member and a mesh element. The securement members are comprised of a flexible fabric. The mesh element is transparent and affixed to inboard portions of the securement elements. The outboard portions may be configured to be placed into releasable gripping engagement with one another by way of mutually-engageable complementary fastener elements. The securement members each include a forward edge and an opposing rearward edge. The mesh element may include a frontal segment having a forward periphery. The forward periphery is preferably in alignment with the forward edges. The mesh element may include a parting-line segment extending oppositely of the forward periphery. The width of the frontal segment may be greater than the corresponding width of the parting-line segment. Moreover, the parting-line segment may include a rearward periphery in alignment with the rearward edges.

10 Claims, 6 Drawing Sheets

(58) Field of Classification Search
CPC ..... A41G 3/0058; A41G 5/00; A41G 5/0053; A41G 5/0093; A42B 1/008; A42B 1/225; A45D 8/36; A45D 8/40
USPC ..... 132/53, 54, 55, 56, 201; 2/171, 174, 2/209.5; D28/41, 92, 93
See application file for complete search history.

(56) References Cited

U.S. PATENT DOCUMENTS 1,634,190 A * 6/1927 Hepner ..... A41G 3/00 132/53
1,740,764 A * 12/1929 Bong ..... A41G 3/00 132/201
2,233,100 A * 2/1941 Jevnikar ..... A41G 3/00 132/53
2,700,977 A * 2/1955 Neerup ..... A45D 8/40 132/273
2,736,325 A * 2/1956 Dvorzsak ..... A41G 5/0006 132/53
3,474,798 A 10/1969 Tillotson
3,788,332 A 1/1974 Abbott et al.
4,155,370 A 5/1979 Nemoto
D333,013 S 2/1993 Scianna
5,265,280 A * 11/1993 Walsh ..... A41D 13/11 128/206.12
5,657,774 A * 8/1997 Niese ..... A41G 5/0093 132/105
5,806,535 A * 9/1998 Becker ..... A41G 3/0016 132/53
6,352,079 B1 3/2002 Bate
7,537,014 B1 5/2009 Yoo
D644,379 S 8/2011 Vanesse
8,261,753 B2 9/2012 Newman et al.
8,266,721 B1 * 9/2012 Mueller ..... A42B 1/041 2/171
D669,633 S 10/2012 Hedgren
D712,094 S 8/2014 Branson
9,027,568 B2 5/2015 Lee
9,107,460 B1 8/2015 Synn et al.
9,138,024 B1 * 9/2015 Solomon ..... A41G 5/0073
9,486,023 B1 * 11/2016 Kim ..... A41G 3/00
D879,382 S * 3/2020 Ning ..... D28/93
2003/0029467 A1 * 2/2003 Katon ..... A41G 3/0033 132/53
2003/0131861 A1 7/2003 Prestia
2004/0149299 A1 8/2004 Kim
2006/0174905 A1 * 8/2006 Bias ..... A41G 5/0093 132/53
2007/0283975 A1 * 12/2007 Ma ..... A41G 5/0093 132/53
2008/0178902 A1 * 7/2008 Moeszinger ..... A45D 8/36 132/273
2011/0023902 A1 * 2/2011 Cho ..... A41G 3/005 132/53
2011/0041866 A1 * 2/2011 Bermeister ..... A45D 8/40 132/273
2011/0073122 A1 * 3/2011 Shigematsu ..... A41G 3/005 132/54
2011/0186065 A1 * 8/2011 Inoue ..... A41G 5/00 132/54
2011/0303234 A1 * 12/2011 Xiangyong ..... A41G 3/0075 132/54
2012/0222692 A1 * 9/2012 Ray ..... A41G 5/0093 132/53
2013/0019889 A1 * 1/2013 Palmer-Rogers .... A41G 3/0041 132/201
2014/0020703 A1 * 1/2014 Tiram ..... A41D 20/00 132/201
2014/0202481 A1 7/2014 Sato et al.
2014/0251362 A1 * 9/2014 Lee ..... A41G 3/00 132/201
2014/0326267 A1 * 11/2014 Peterson ..... A41G 5/004 132/201
2015/0013708 A1 1/2015 Chamberlain
2015/0128979 A1 5/2015 Suh
2015/0327609 A1 11/2015 Suh
2017/0095026 A1 4/2017 Chung
2018/0007988 A1 1/2018 Kim et al.
2018/0055122 A1 * 3/2018 Kim ..... A41G 3/0033
2019/0104793 A1 * 4/2019 Young ..... A41G 5/004

FOREIGN PATENT DOCUMENTS

GB 191401976 A * 5/1914 ..... A41G 3/00
GB 1388300 3/1975
GB 2537182 A * 12/2016 ..... A41G 5/00
WO WO-2015064870 A1 * 5/2015 ..... A41G 3/005

OTHER PUBLICATIONS

JP Design Registration No. D1379926, entitled "Retention band which is something which", Publication date Feb. 15, 2010; Registration owner: Brain Ltd.
JP Design Registration No. D1391781, entitled "Hair Band"; Publication date Jul. 5, 2010; Registration owner: Sante Professional Corporation.
JP Design Registration No. D1586936, entitled "Head band"; Publication date Oct. 2, 2017; Registration owner: Takayuki Onuma.
KR Design Registration No. 3002983000000, entitled "Cold Pack Pack Band"; Publication date May 17, 2002; Applicant: Lee Seong Hoon.
KR Design Registration No. 3005060070000, entitled "Perfume Blocking Hair Band"; Publication date Sep. 17, 2008; Applicant: Jeong, Myoung-Seok.
KR Design Registration No. 3006686140001, entitled "Hair Band"; Publication date Nov. 22, 2012; Applicant: J&J USA Co. Ltd.
Title: "Discover ideas about U part wig"; URL: https://www.pinterest.com/pin/630644754049080146/; Published date: Feb. 2019.
Title: "Milano Collection Original WiGrip Wig Comfort Band"; URL: http://www.mcwigs.com/wigrip.html; Published date: Sep. 22, 2017.

* cited by examiner

WIG GRIP APPARATUS

TECHNICAL FIELD

The disclosure herein relates generally to wigs and hairpieces. More particularly, the present disclosure relates to devices for facilitating the stable attachment of wigs to the head of a wearer.

BACKGROUND

The lace foundation portions of conventional wigs and frontal hairpieces tend to be transparent, and therefore need to lay very flat on the scalp in order to optimally achieve a natural appearance. Consequently, when a conventional wig gripping device is worn between the wearer's scalp and the conventional wig, that conventional device is frequently visible through the hairpiece foundation to the eye of an outside observer. What is needed is a wig grip device that helps removably secure a lace-foundation wig or frontal hairpiece to the head of a wearer, while preserving the appearance that the hair stands of the headpiece originate from the underlying scalp at the location of the front hairline and hair part of the hairpiece.

SUMMARY

One or more deficiencies of the prior art are solved by way of embodiments of the wig grip apparatus in accordance with the present disclosure.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
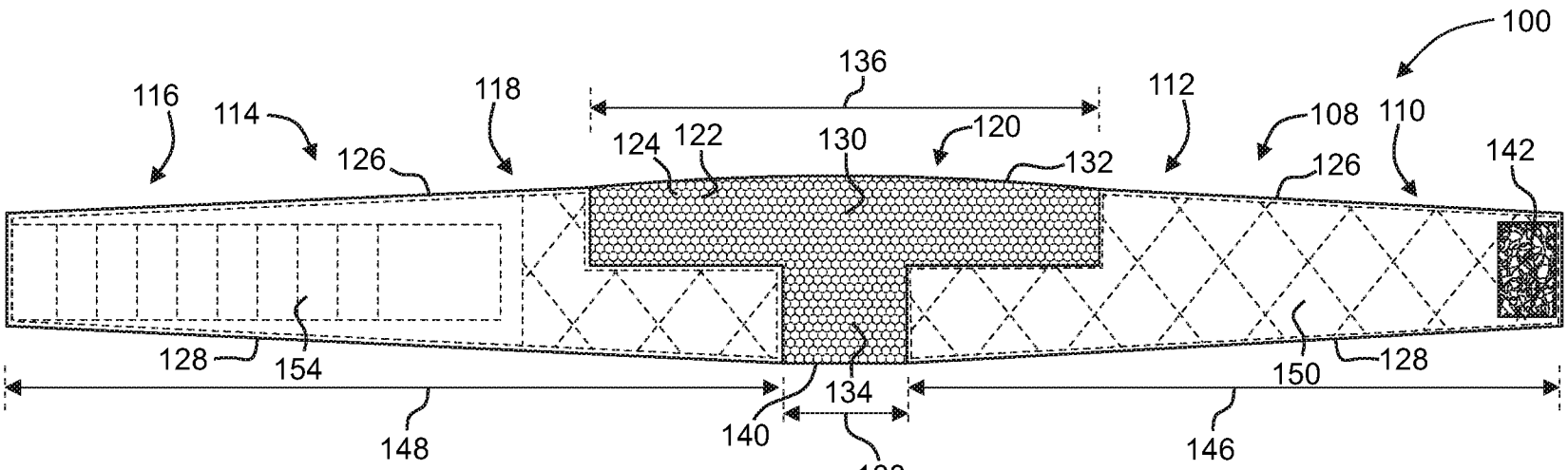
FIG. 1 is a diagrammatic bottom plan view of one example wig grip apparatus in accordance with the present disclosure.

Referring now to the drawings, like reference numerals designate identical or corresponding features throughout the several views.

With reference to the several drawings, embodiments of a wig grip apparatus are shown generally at 100, and are configured to facilitate enhanced securement of a wig 102 to the head (scalp) 106 of a wearer. The wig grip apparatus 100 may preferably comprise at least a first securement member 108, a second securement member 114 and a mesh element 120.

Figure 2:
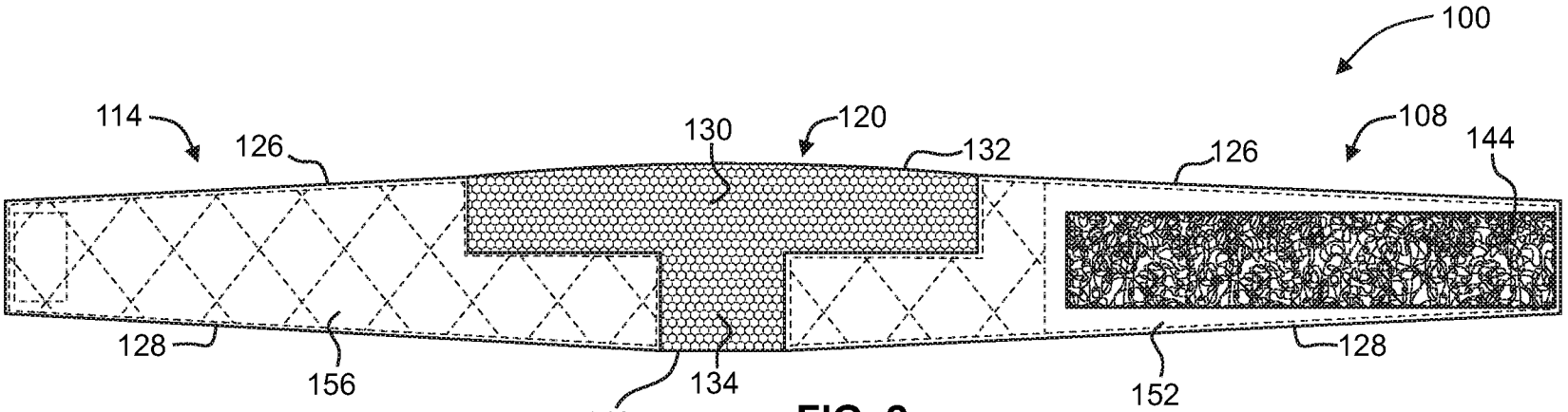
FIG. 2 is a diagrammatic top plan view of the example wig grip apparatus shown in FIG. 1.
Figure 3:
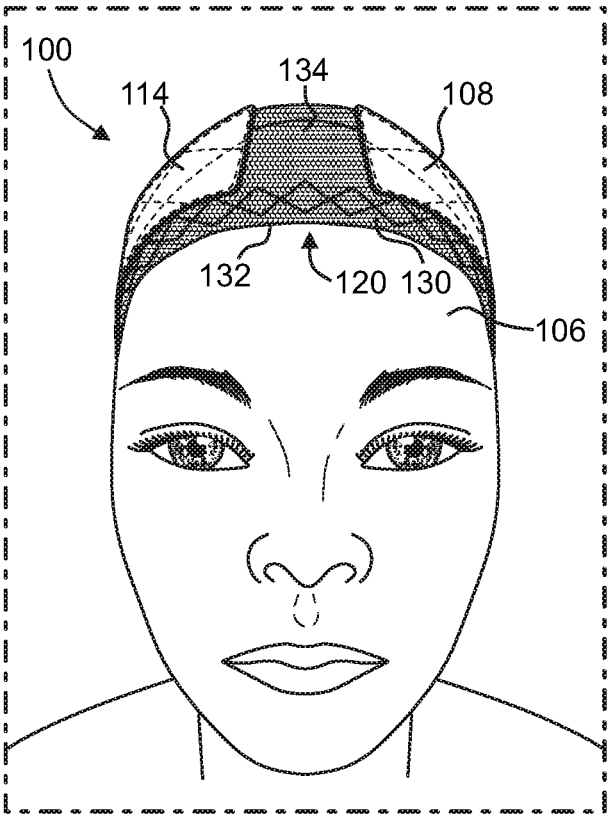
FIG. 3 is a diagrammatic front view illustrating the example wig grip apparatus of FIG. 1 having been secured to the head of a wearer prior to application of a wig.
Figure 4:
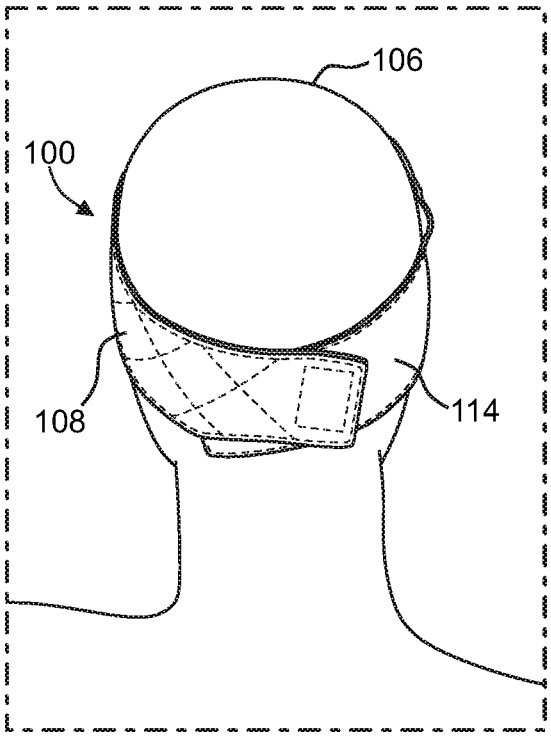
FIG. 4 is a diagrammatic rear view illustrating the example wig grip apparatus of FIG. 1 secured to the head of a wearer prior to application of the wig, with the complementary fastener elements being in their releasable gripping engagement with one another.
Figure 5:
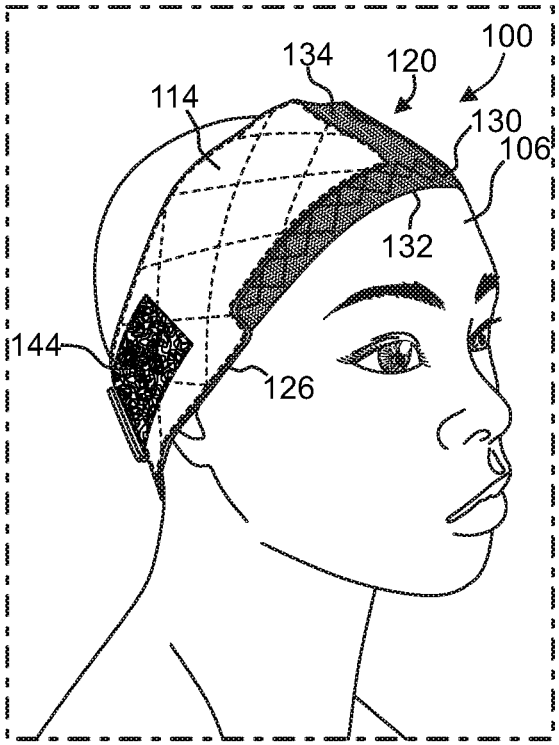
FIG. 5 diagrammatic right-front perspective view illustrating the example wig grip apparatus of FIG. 1 secured to the head of a wearer prior to application of the wig, with the complementary fastener elements being in their releasable gripping engagement with one another.

Referring to FIGS. 1 and 2, the first securement member 108 may be comprised of a flexible fabric and may have a first outboard portion 110 and a first inboard portion 112 disposed oppositely of one another. Similarly, the second securement member 114 may be comprised of a flexible fabric and may have a second outboard portion 116 and a second inboard portion 118 disposed oppositely of one another. The first securement member 108 may have a first length 146 and the second securement member 114 may have a second length 148. The first length 146 may be greater than the second length 148.

The mesh element 120 may be transparent and affixed to the first inboard portion 112 and the second inboard portion 118. Such affixing may be way of, for example, stitching, adhesive, a combination thereof or the like. The term "transparent" is generally used herein to refer to a material capable of transmitting light therethrough so that bodies and surfaces lying beneath can be clearly seen through the material. Examples of a transparent mesh may include mesh fabrics that are fine or sheer enough to be seen through. More particularly, in certain preferred embodiment of the wig grip apparatus 100, the mesh element 120 may have a percent visible transmittance of at least 70%. In particular preferred embodiment of a wig grip apparatus 100, the mesh element 120 may have a percent visible transmittance of at least 85%. In certain preferred embodiment of a wig grip apparatus 100, the mesh element 120 may be comprised of a nylon mesh fabric, such as a hexagonal nylon mesh fabric. In specific preferred embodiment of a wig grip apparatus 100, the mesh element 120 is T-shaped (e.g., includes two distinct portions that extend orthogonally to one another).

The first outboard portion 110 and second outboard portion 116 are preferably configured to be placed into releasable gripping engagement with one another. In preferred embodiments of a wig grip apparatus 100, the first and second outboard portions 110 and 116 may include complementary fastener elements 142 and 144 which are mutually engageable for providing the aforementioned releasable gripping engagement. The complementary fastener elements may be, for example, a first hook-and-loop fastener member and a second hook-and-loop fastener member (i.e., one fastener element having one more hooks and the other fastener element having one or more loops).

Referring to FIGS. 1 and 2, the securement members 108 and 114 may each include a forward edge 126 and an opposing rearward edge 128. The mesh element 120 may include a frontal segment 130 having a forward periphery 132, and the forward periphery 132 may preferably be in alignment with the forward edges 126. In certain embodiments, the forward periphery 132 and the forward edges 126 may collectively follow a non-linear forward pathway (See, for example, FIGS. 1 and 2). The non-linear forward pathway may be arcuate or angled in some fashion.

Referring to FIGS. 1 and 2, the mesh element 120 may include a parting-line segment 134 extending oppositely of the forward periphery 132. The frontal segment 130 may have a frontal segment width 136, and the parting-line segment 134 may have a parting-line segment width 138 defined in parallel with the frontal segment width 136. In certain preferred embodiments of a wig grip apparatus 100, the frontal segment width 136 is greater than the parting line segment width 138.

Referring to FIG. 1, the parting-line segment 134 may include a rearward periphery 140. The rearward periphery 140 may be in alignment with the rearward edges 128. In such embodiments, the rearward periphery 140 and the rearward edges 128 may collectively follow a non-linear rearward pathway (See, for example, FIGS. 1 and 2). The non-linear rearward pathway may be arcuate or angled in some fashion.

Figure 6:
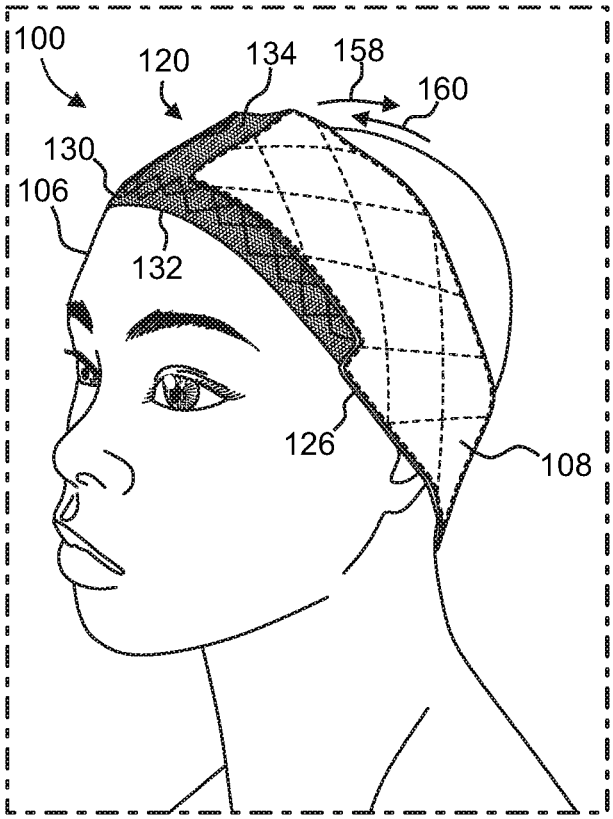
FIG. 6 diagrammatic left-front perspective view illustrating the example wig grip apparatus of FIG. 1 secured to the head of a wearer prior to application of the wig.

Referring to FIGS. 1 and 2, the first securement member 108 may have a first inner surface 150 and a first outer surface 152. Similarly, the second securement member 114 may have a second inner surface 154 and a second outer surface 156. In particular preferred embodiments of the wig grip apparatus 100, the first and second securement members 110 and 114 may be generally opaque and may comprise velvet or velour. For example, referring to FIGS. 1 and 6, the inner surfaces 150 and 154 may comprise a velour with piled fibers oriented unidirectionally so as to cause increased friction between the securement members and the scalp 106 of the wearer when the wig grip apparatus 100 is pulled in a rearward direction 158 across the scalp 106 (i.e., higher friction than friction caused by movement of the wig grip apparatus in the forward direction 160). Additionally or in the alternative, referring to FIGS. 2 and 6, the outer surfaces 152 and 156 may comprise a velour with piled fibers oriented unidirectionally so as to cause increased friction between the securement members and the wig foundation 104 when the wig foundation 104 is pulled in a rearward direction 158 across the wig grip apparatus 100 (i.e., higher friction than friction caused by movement of the wig in the forward direction 160). These frictional adaptations allow the wig grip apparatus 100 to help supportingly affix the wig 102 to the scalp 106 of the wearer, particularly in the case of heavier wigs that tend to pull backwards from the forehead of the wearer.

Figure 7:
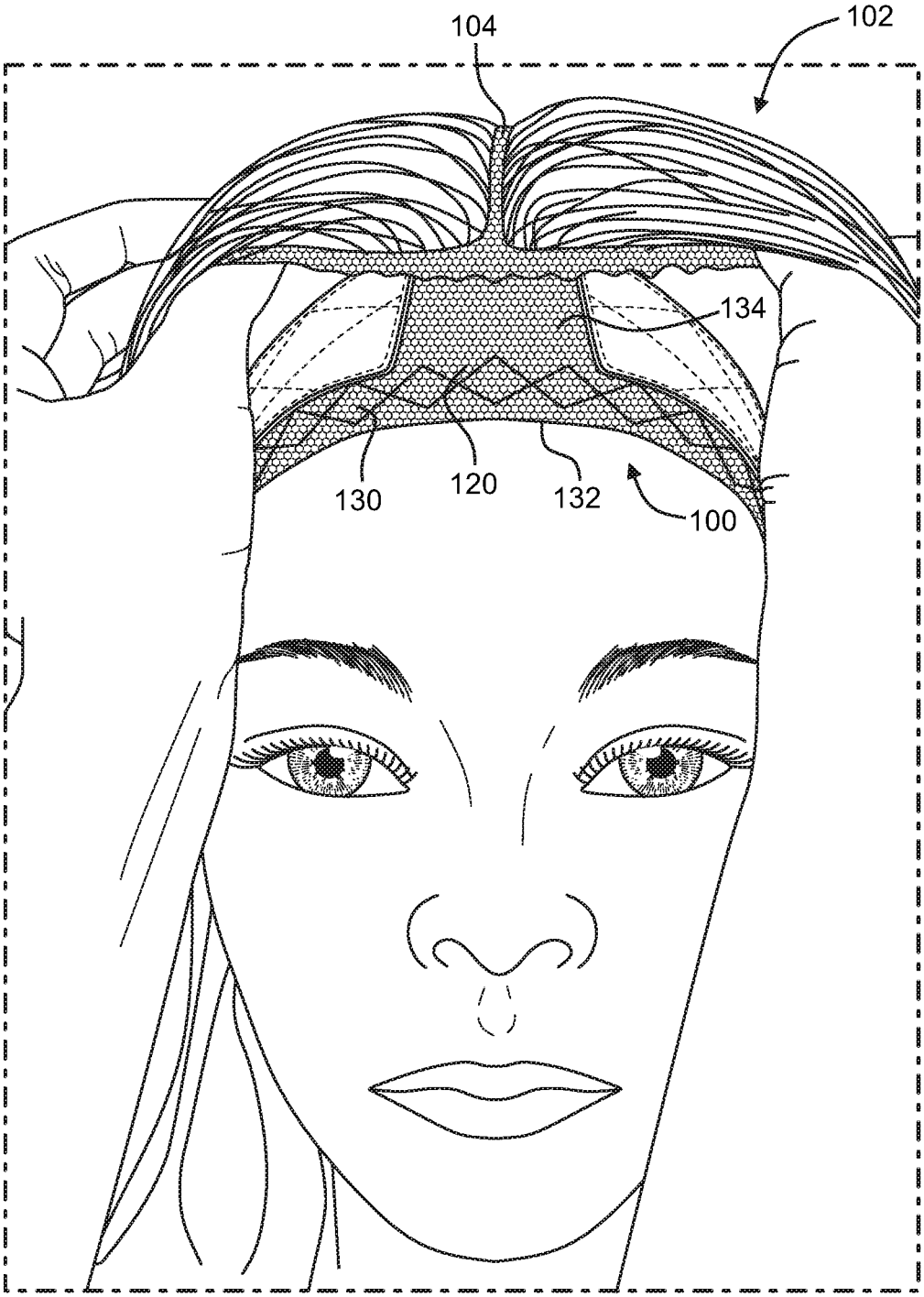
FIG. 7 is a diagrammatic front view illustrating the example wig grip apparatus of FIG. 1 secured to the head of a wearer, and the wig in the process of being applied over the wig grip apparatus.
Figure 8:
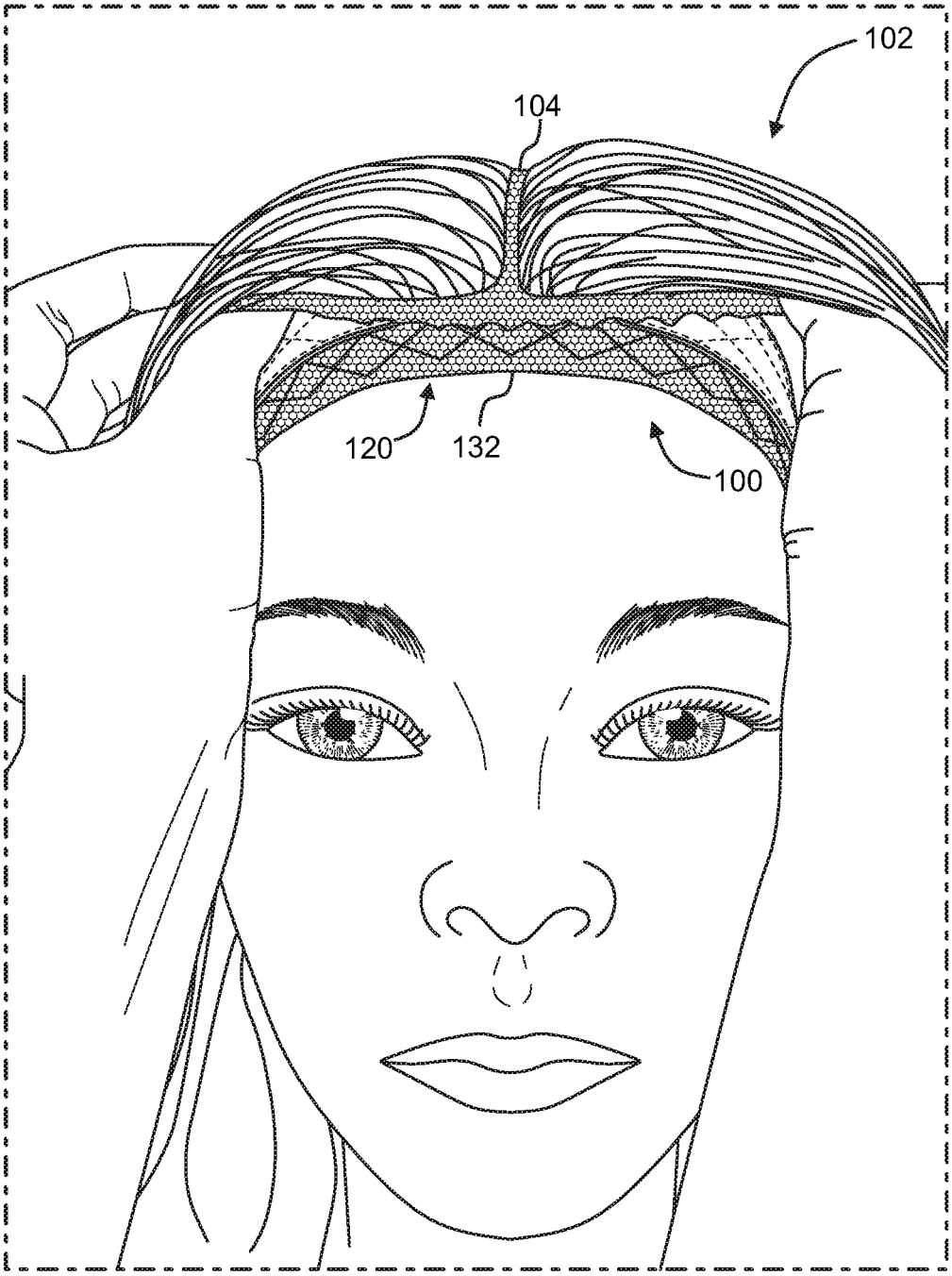
FIG. 8 is a diagrammatic front view similar to that of FIG. 7, but wherein the forward section of the wig foundation has been brought into position to at least partially overlap with the frontal segment of the mesh element.
Figure 9:
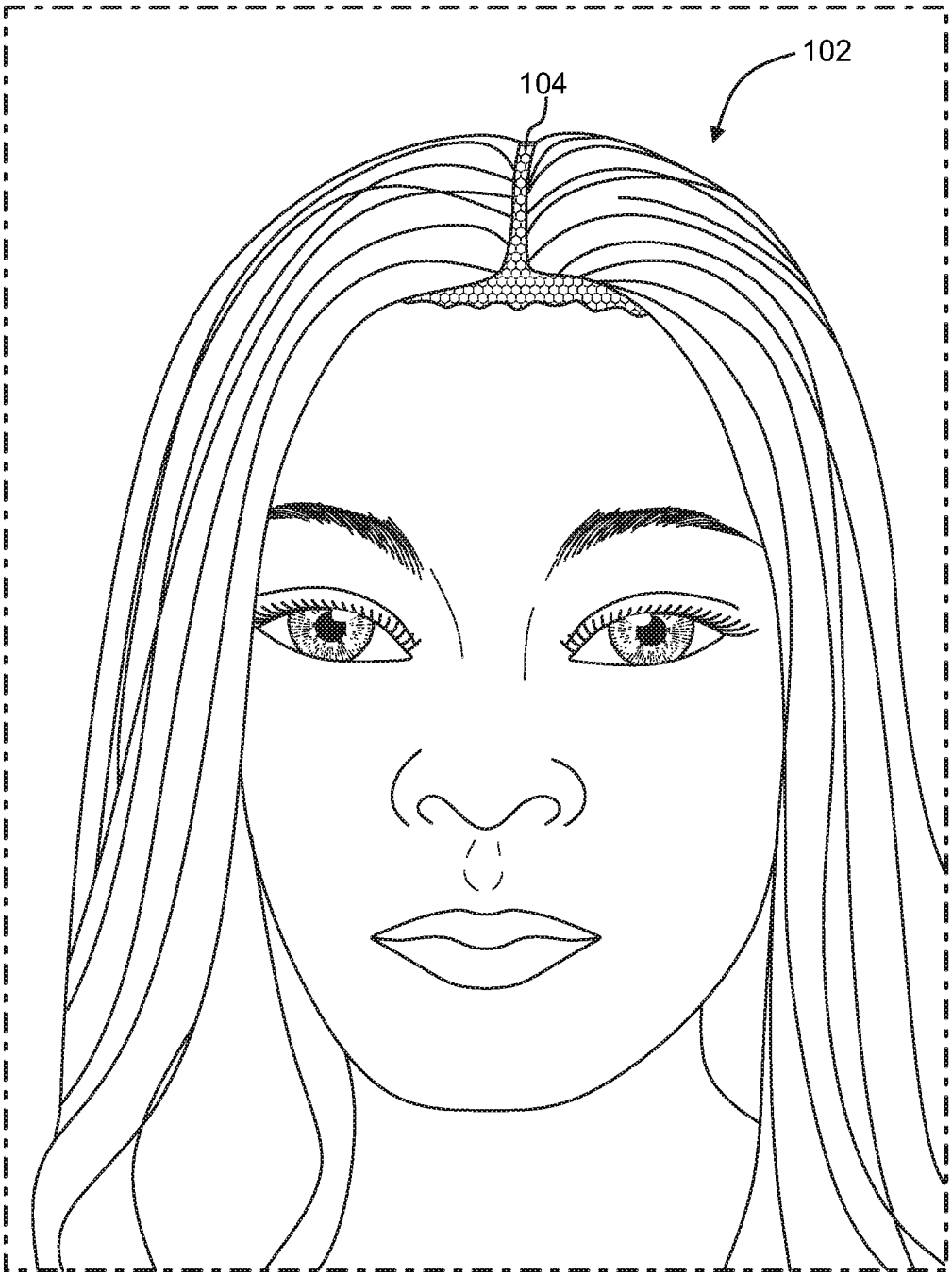
FIG. 9 is a diagrammatic front view similar to that of FIG. 8, but wherein application of the wig over the wig grip apparatus is complete, and the forward section of the wig foundation at least partially overlaps with the frontal segment of the mesh element.

FIGS. 7-9 illustrate a sequence of applying the wig 102 having a wig foundation 104 to the head 106 of a wearer, with the wig grip apparatus 100 disposed therebetween. Various embodiments of a wig grip apparatus 100 may be adapted for use with lace top wigs and frontals. Lace foundation wigs and frontals generally have a transparent foundation 104 and need to lay very flat to optimally produce a natural appearance. When a conventional gripping object is worn underneath such conventional wigs and frontals, that object is typically visible to the human eye. Advantageously, the transparency of the mesh element 120 and its ability to lay flat against the scalp 106 allows the natural appearance and color of the wearer's scalp 106 to pass through the wig grip apparatus 100 and the wig foundation 104. The mesh element 120 is generally configured to sit flat on the forehead when the user's front hairline would be and where part of the lace wig or frontal will be positioned. This allows the wearer to secure the wig or frontal to the head in the flattest, most natural way possible, thereby avoiding creating bulk that may appear unnatural near the front and/or parting line of the hairpiece. Such construction also helps it appear to an outside observer that the hair stands of the wig 102 interface directly with the scalp 106 of the wearer.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of using a wig grip apparatus for facilitating enhanced securement of a hairpiece to the head of a wearer, the method comprising:

providing a wig grip apparatus comprising (a) a first securement member comprised of a velvet or velour and having a first outboard portion and a first inboard portion disposed oppositely of one another;

(b) a second securement member comprised of a velvet or velour and having a second outboard portion and a second inboard portion disposed oppositely of one another; and (c) a mesh element being transparent and affixed to the first inboard portion and the second inboard portion, wherein the mesh element includes a forward periphery and the wig grip apparatus terminates at the forward periphery;

securing the wig grip apparatus to the head of the wearer; and applying a hairpiece having a foundation to the head, whereby the wig grip apparatus is disposed between the head and the foundation.

2. A method as defined in claim 1, wherein the step of securing results in the wig grip apparatus encircling the head of the wearer.

3. A method as defined in claim 1 wherein the mesh element is comprised of a nylon mesh fabric.

4. A method as defined in claim 3 wherein the nylon mesh fabric is hexagonal.

5. A method as defined in claim 1 wherein (a) the securement members each include a forward edge and an opposing rearward edge; and (b) the forward periphery is in alignment with the forward edges.

6. A method as defined in claim 5 wherein the forward periphery and the forward edges collectively follow a non-linear forward pathway.

7. A method as defined in claim 5 wherein the mesh element includes (a) a frontal segment having the forward periphery and a frontal segment width; and (b) a parting-line segment extending oppositely of the forward periphery and having a parting-line segment width defined in parallel with the frontal segment width, the frontal segment width being greater than the parting line segment width.

8. A method as defined in claim 7 wherein (a) the parting-line segment includes a rearward periphery; and (b) the rearward periphery is in alignment with the rearward edges.

9. A method as defined in claim 8 wherein the rearward periphery and the rearward edges collectively follow a non-linear rearward pathway.

10. A method as defined in claim 1 wherein the mesh element is T-shaped.

* * * * *